United States Patent [19]

Eberhart

[11] Patent Number: 4,969,282

[45] Date of Patent: Nov. 13, 1990

[54] GLASS BLOCK ILLUMINATED DISPLAY

[76] Inventor: Wolfgang R. Eberhart, 326 Devonshire Road, Windsor, Ontario, Canada, N8Y 2L3

[21] Appl. No.: 278,915

[22] Filed: Dec. 2, 1988

[51] Int. Cl.[5] ..... G09F 19/00

[52] U.S. Cl. ..... 40/545; 40/541; 40/553; 52/105; 52/311; 362/145; 362/362

[58] Field of Search ..... 226/51, 93, 94, 76; 40/545, 606, 552, 570, 541, 584, 312, 661, 553; 52/105, 311, 582, 307, 309.17, 515; 362/145, 262, 147, 362, 38; 220/82 R

[56] References Cited

U.S. PATENT DOCUMENTS

| | | | |
|---|---|---|---|
| D. 252,831 | 9/1979 | Sovaiko | D26/51 |
| D. 257,897 | 1/1981 | Scholze et al. | D26/93 |
| D. 275,130 | 8/1984 | Sovaiko | D26/94 |
| D. 291,928 | 9/1987 | Morten | D26/76 |
| 785,573 | 3/1905 | Ringo | 40/661 |
| 1,943,772 | 1/1934 | Prouty | 40/545 |
| 1,991,469 | 2/1935 | Slayter | 52/311 |
| 2,090,989 | 8/1937 | van Deventer et al. | 40/545 |
| 2,107,994 | 2/1938 | Hazelton, Jr. | 52/311 |
| 2,158,089 | 5/1939 | Slick | 52/582 |
| 2,175,242 | 10/1939 | Berger | 404/545 |
| 2,216,220 | 10/1940 | Baker | 362/147 |
| 2,542,581 | 2/1951 | Schreffler | 52/311 |
| 3,330,079 | 7/1967 | Mitchell et al. | 52/105 |
| 3,651,975 | 3/1972 | Callan | 220/82 R |
| 4,223,377 | 9/1980 | Williams | 362/362 |
| 4,611,265 | 9/1986 | Davis | 40/552 |

FOREIGN PATENT DOCUMENTS

| | | | |
|---|---|---|---|
| 100682 | 3/1937 | Australia | 40/545 |
| 2910146 | 9/1980 | Fed. Rep. of Germany | 40/606 |
| 734393 | 7/1955 | United Kingdom | 40/570 |

OTHER PUBLICATIONS

The Smithsonian, Jun. 1989, p. 85.

*Primary Examiner*—Kenneth J. Dorner
*Assistant Examiner*—J. Hakomaki
*Attorney, Agent, or Firm*—Dykema Gossett

[57] ABSTRACT

An illuminated display or sign includes a hollow glass block defining a closed chamber. One or more block walls are severable for access to the chamber. A neon display or other light source of any configuration is mounted upon the glass block and includes tubular extensions sealed through one wall of the block enclosing electrodes within the chamber. A transformer is enclosed within the chamber with output leads connected to the electrodes. A switch is mounted upon the block and projects into the chamber with a exterior control. Electric leads are connectable to a power source then into the block and are connected to the transformer with a switch interposed in one of the electrical leads within the chamber. As a modification, a display sign is supported within the chamber. As a further modification, two or more glass blocks are arranged in a row or intersecting rows to form a panel, with an independent display in each block or a unit display extending into and enclosed by a plurality of adjacent blocks.

5 Claims, 2 Drawing Sheets

GLASS BLOCK ILLUMINATED DISPLAY

FIELD OF THE INVENTION

The present invention relates to illuminated displays or signs mounted upon or within glass blocks.

BACKGROUND OF THE INVENTION

Previously, signs of various types including fluorescent or neon or other lighting have been employed including displays of any particular configuration including street numbers, exit signs or any interesting design which normally require a support and a power source for the sign together with a transformer for regulating the effective voltage delivered thereto.

THE PRIOR ART

Signs of this general type are shown in one or more of the following Patents:

| NUMBER | INVENTOR | DATE |
|---|---|---|
| | U.S. Pat. Nos. | |
| 2,181,889 | E. C. Hanson | December 5, 1939 |
| 2,216,220 | E. B. Baker | October 1, 1940 |
| 2,214,447 | E. B. Bave | September 10, 1940 |
| 2,296,893 | H. J. Austin | September 29, 1942 |
| 2,540,271 | L. G. Lytton | February 6, 1951 |
| 4,303,969 | Jerrol D. Hamilton, et al. | December 1, 1981 |
| 4,413,311 | Orenstein | November 1, 1983 |
| 4,569,004 | Peterson | February 4, 1986 |
| | FOREIGN PATENTS | |
| 287,672 | British, George Greenfield | January 27, 1927 |
| 678,892 | French, M. Drago Grbovic | July 23, 1929 |
| 1,126,730 | French, N. V. Phillps | June 27, 1955 |

SUMMARY OF THE INVENTION

An important feature of the present invention is to provide an illuminated display or sign which employs a hollow glass block as a base which has mounted thereon or therein a tubular neon display or equivalent light display wherein all of the electrical connections and power for energizing the display are protectively enclosed within the interior chamber of the glass block and including a transformer having an outlet connected to the electrodes of a neon display for illustration. An on/off manual switch is mounted upon and extends into the interior of the block chamber together with a pair of power leads which extend through the wall of the glass block and are adapted for connection to a power source and their other ends are connected to the transformer and wherein the switch upon the interior of the block is interposed into one of the power leads within the block.

As another feature there is provided a high voltage tubular neon display or sign of a predetermined configuration which is supportably mounted upon one of the glass block walls such as the top wall, which includes a pair of tubular supports. These supports with electrodes positioned therein are projected through the wall into the chamber of the block. The output of a transformer is in the range of 3,000 to 5,000 volts DC, for illustration protectively enclosed within the block and connected to the electrodes therein. A pair of electrical leads extend through one of the walls of the block and are adapted for connection to an electrical power source, such as 110 volts AC, and with said leads upon the interior of the block connected to the transformer.

As another feature a manual on/off switch is mounted upon the block and extends to the interior chamber thereof, includes an exterior control and upon the interior of the block is connected into one of the power leads from the power source to the transformer.

As still another feature the glass block includes side, top and bottom walls wherein one of the walls is severable from the other walls for access to the chamber for replacement of the connections of the transformer to the electrodes or the connection between the switch and the transformer, the connection from the power source from the transformer and to the switch. A suitable adhesive is employed in bonding the corners of the severable wall to the adjacent walls.

As another feature the walls of the block on the inside or outside are coated or tinted so as to render the interior invisible so as to hide the presence of the transformer and other electrical connections on the interior of the block protectively enclosed therein.

As still another feature the present illuminated display includes a hollow glass block which is transversely severable for access there into and for resealing and cementing and wherein there is provided an internal peripheral flange to support a panel upon which it is mounted a display including any other type of light source, such as a fluorescent light source or light bulb or the like. All of the electrical circuitry including the sign or display is nested and protectively enclosed within the glass block.

As a further feature of the present illuminated display is nested upon the interior of the block along with the electrical connections therefore and protectively enclosed therein. A power voltage is delivered to the block is in the area of 12 volts AC and the power delivered by the internal transformer is in the range of 6 to 8 volts, for illustration, creating a lower power factor for the illumination of the internal sign or other display.

As another feature of the present glass block with illuminated display therein may be incorporated into two or more blocks arranged side by side and wherein the display may extend between a pair of adjacent blocks upon the interior of the chambers thereof, with a single source of power provided within one block. Alternatively there may be two or more blocks arranged side by side with an individual neon or other illuminated display nested therein and having an independent power source for that display wherein the displays from block to block may differ in appearance.

These and other features and objects will be seen from the following specification and claims in conjunction with the appended drawings.

THE DRAWINGS

BRIEF DESCRIPTION OF THE EMBODIMENTS

It will be understood that the above drawings illustrate merely a preferred embodiment of the invention and that other embodiments are contemplated within the scope of the claims hereafter set forth.

Figure 1:
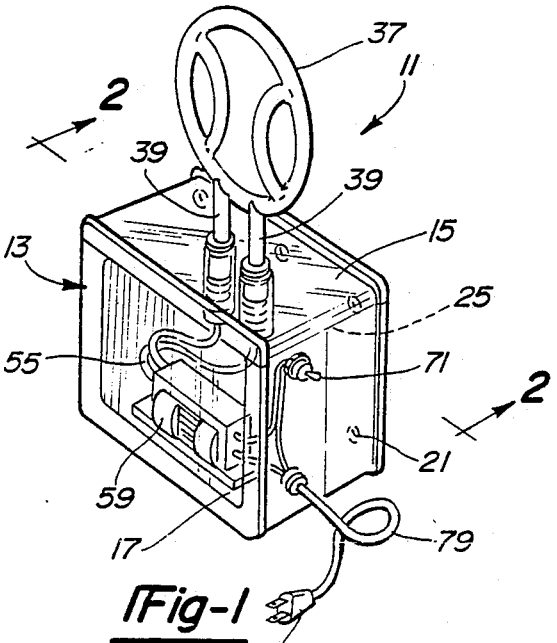
FIG. 1 is a front perspective view of a glass block with an illuminated display mounted thereon.
Figure 3:
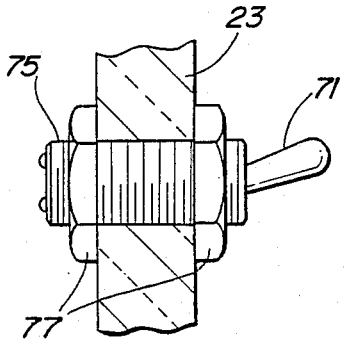
FIG. 3 is a fragmentary view of the on/off switch shown in FIG. 2, on an increased scale.
Figure 2:
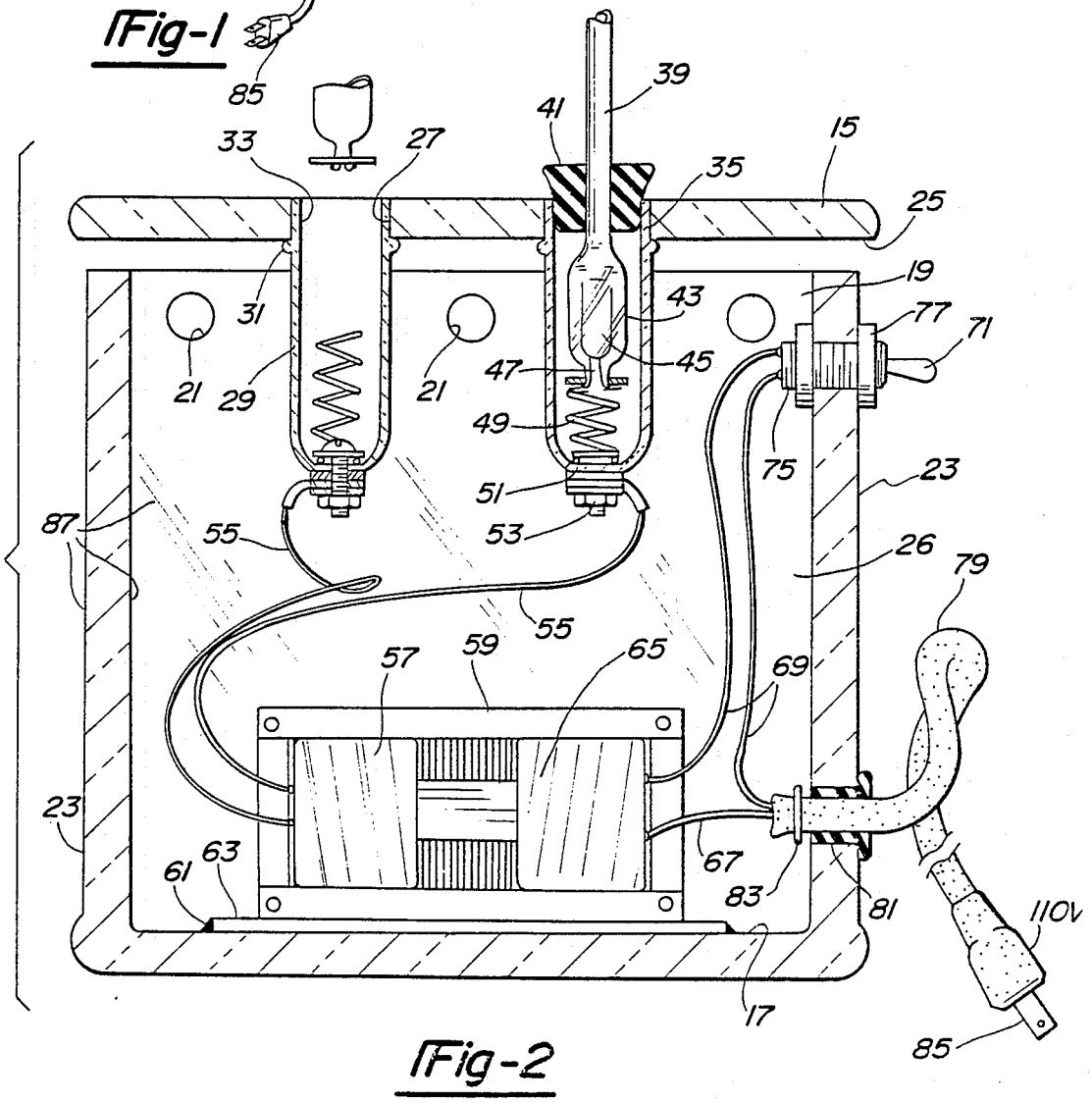
FIG. 2 is a partly exploded transverse section thereof taken in the direction of arrows 2—2 of FIG. 1, and on an increased scale.

Referring to the drawings, one embodiment of the illuminated display is designated at 11, FIGS. 1, 2 and 3 which includes a hollow glass block 13 such as might be employed for outdoor use including top wall 15, bottom wall 17, back wall 19 and side wall 23. A plurality of vent apertures 21 are formed through back wall 19, and additional apertures are shown such as through one side wall 23 in order to receive the on/off switch 71 and the power leads 79.

In the illustrative embodiment and wherein the illuminated display or sign is supportively mounted upon top wall 15, there is shown at 25 a cut or severance line. By the use of a diamond saw blade top wall 15 is separated from the remaining walls such as shown in FIG. 2 for access to the interior chamber 26 of the glass block.

Formed through top wall 15 of a pair of bores 27, in the illustrative embodiment having a diameter of 35 mm. There is shown a pair of cylindrical housings 29 of a heat resistant glass having an annular top bead 31 intermediate its ends and upon one end the shank 33 which is snugly projected into the respective bores 27 and sealed therein by a silicon glue or equivalent cement 35, FIG. 2. In the illustrative embodiment, any one of a plurality of displays or signs 37 may be employed such as illustratively shown in FIG. 1 of a particular design in the form of a neon tube or a fluorescent tube or other lighting source defining a sculpture which is gas filled as is conventional in the art.

The tubular illuminated display 37 terminates in a pair of tubular supports 39. These supports extend through the rubber stoppers 41 which are projected within the upper ends or shanks of the respective cylindrical housings 29. The respective tubular supports terminate in tubular bases 43, FIG. 2, which have closed ends and enclosed the electrodes 45 for energizing the neon or fluorescent tube 37. Each electrode terminates in a conductor 47 which engages one end of the conductive compression spring 49. The opposite end of the spring is anchored at 51 at the bottom of the tube base by the connector 53.

The respective connectors terminate in the electric leads 55 to the secondary 57 of transformer 59. The transformer is secured to bottom wall 17 of the glass block 13 such as by a silicon glue or cement 61 relative to the transformer mount flange 63. The primary coil 65 of said transformer is connected to the first and second power leads 67 and 69. The on/off switch 71 includes a plastic or otherwise nonconductive body 75 which is projected through an aperature in the side wall 23 of the glass block and retained thereon by the nuts. The on/off switch 71 is interposed within the power leads 69 to control electrical activation of transformer 59.

The respective power leads 67 and 69 terminate in the electrical lead 79 which extends through side or end wall 23 of the glass block and terminates in the conventional plug 85 adapted for connection to a 110 volt AC power source.

In the illustrative embodiment shown in FIG. 2 the output of the secondary coil 57 of transformer 59 is adaptive to deliver electrical power in the range of 2,000 to 5,000 volts at 20 to 30 MA. The interior and/or exterior surface of the respective side and end walls of the glass block are spray painted or frosted at 87 in order to conceal the interior of the glass block and to render invisible, the electrical connections therein including the transformer and electrical connections to the electrodes supported and depended from top wall 15. The layer of paint 87, fragmentarily shown, in FIG. 2 is a heat resistant paint.

The lead wire 79 to the power source, upon the interior of the glass block includes an anchor 83 to prevent accidental retraction of the lead wire 79 or disconnect from the lead wires 67 and 69 upon the interior of the glass block.

The glass block described with respect to FIGS. 1, 2 and 3 mounting the display or sign 37 is sometimes referred to as 110 volt block for a high power factor such as would be used for a display upon the outside of a building for illustration.

The glass block or housing 13 is standard for North American manufacturers and comes in various sizes and lengths.

While FIGS. 1 and 2 show one glass block, the display sign 37 could be mounted upon a pair of such blocks arranged side by side such as for larger signs.

The transformer 59 is CSA approved and is of a standard conventional sign.

A modification of the glass block display is designated at 89 in FIGS. 4 through 8 and includes a pair of opposed glass block sections 91 and 93 with the glass block being of a conventional construction and having a wall in the range of 8 mm to 10 mm. In the illustrative embodiment a single glass block is transversely cut intermediate its ends with a precision diamond saw blade to form the two glass block sections 91 and 93 shown in FIG. 4 spaced apart for access to their interiors 99 and shown assembled and cemented together at 105 at their corners in FIGS. 5 and 6 with the sign and the electrical connections enclosed therein.

Figure 4:
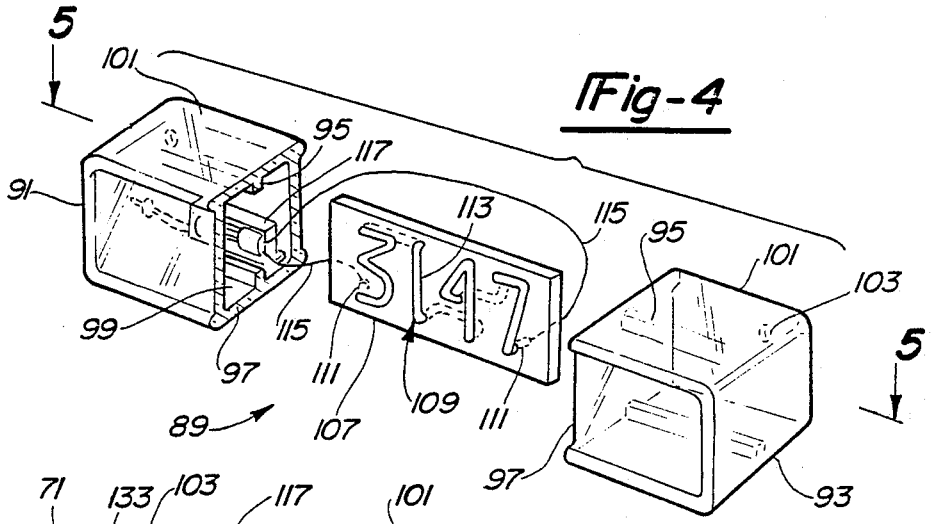
FIG. 4 is an exploded perspective view of a modified glass block display with the sign incorporated within the glass block.

In the conventional construction of glass blocks of this type and in the molding process of these blocks normally formed by mating halves there is an internal peripheral mold flange upon and along the interior walls thereof to define a mount flange 95, FIG. 4.

The corresponding mating edges 97 of the respective block halves 91 and 93 define an internal chamber 99. Rear wall 101 of the assembled blocks such as shown in FIG. 5, includes a plurality of air vents 103 and with others of the corresponding walls of the block apertured in which is supportably mounted an on/off switch, such as the switch 71 and to receive the power leads such as the power leads 123, FIG. 5.

Figure 5:
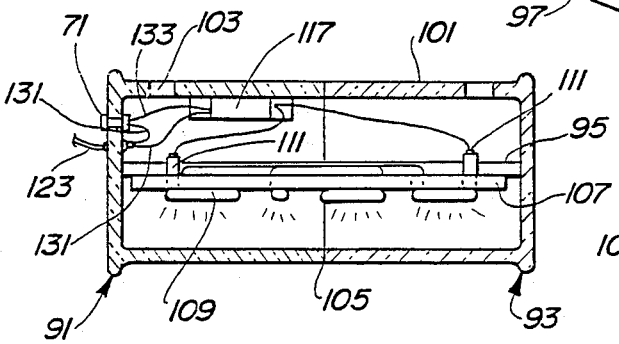
FIG. 5 is a longitudinal section of the glass blocks as assembled, and taken in the direction of arrows 5—5 of FIG. 4.

An elongated panel 107 of wood or plastic material is positioned within the block sections 91 and 93 of the unit block when assembled, FIG. 5 and bears frictionally against the internal peripheral flange 95. A neon tubular sign or a fluorescent type of sign such as continuous tubing which may contain numbers as shown in FIG. 4 or other indicia 109 mounted upon the panel 107 and secured thereto as by a suitable glue such as silicon glue.

The panel 107 with the display or sign 109 secured thereto includes a pair of electrodes 111 connected by a pair of lead wires 115 to the secondary coil of transformer 117. In the illustrative embodiment transformer 117 operates under 12 volts AC and is cemented upon or mounted upon rear wall 101 for illustration. The secondary of the transformer delivers to the respective electrodes 111 a voltage of six to eight volts DC adapted for the particular neon or fluorescent sign 109.

Figure 7:
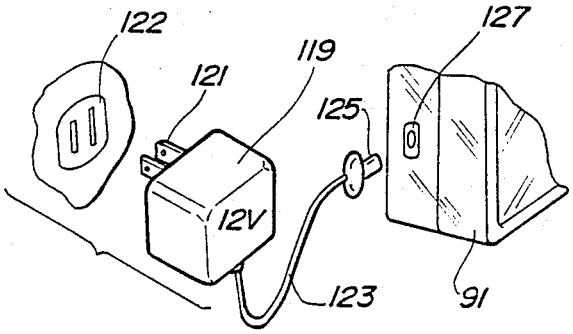
FIG. 7 is a bracketed perspective view of the low voltage power source directed to the glass block as fragmentarily shown and corresponding to FIG. 5.
Figure 8:
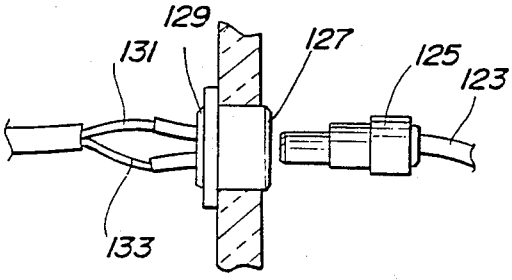
FIG. 8 is a fragmentary elevational view of the connections of the low power source to an electrical socket within the glass block wall such as shown in FIG. 7.

In this embodiment, sometimes referred to as 12 volt block low power factor there is disclosed a conventional power supply 119 for delivering 12 volts AC to the assembled blocks including connectors 121 adapted for connection to a 110 volt AC power source or female plug 122, FIG. 7.

Power source 119 terminates in the output lead 123 and the plug 125 adapted for projection into the socket 127 upon the exterior of the end wall of the glass block 91, FIG. 7. As further shown in detail in FIG. 8 connected to said socket and upon the interior of the block is a plug 29 which includes a first lead 131 which is connected directly to the transformer 117. There is included a second lead 133 also connected to the transformer but wherein the on/off switch 71 is interposed therein as shown in FIG. 5 for controlling the energizing of the transformer 117 and in turn the illuminated display 109.

Figure 9:
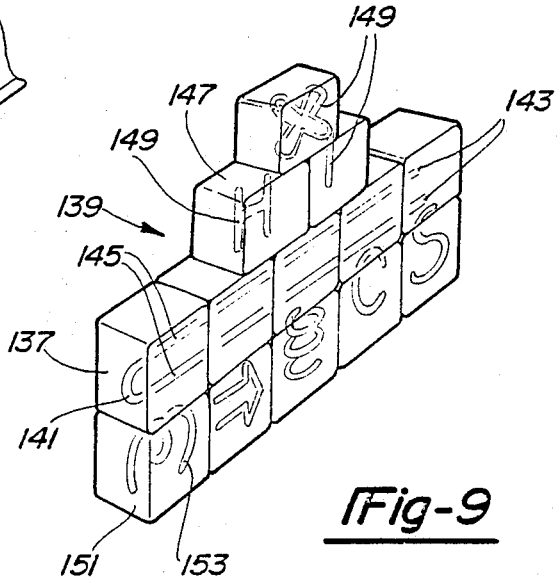
FIG. 9 is a front perspective view of a plurality of blocks arranged in a row or rows and wherein the display may occupy a plurality of blocks or individual displays are shown in some of the blocks.

A modification of the present invention is disclosed in FIG. 9 in the form of one or a plurality of glass blocks 137 arranged in a line which are hollow as initially manufactured which may be used to form a wall or a panel 139 and wherein in connection with the respective glass blocks 137 arranged in a horizontal row there is projected between a series of said adjacent contacting blocks a single neon tube 141 or other display which is enclosed within the series of blocks and terminates in the pair of electrodes 143 within the end block shown.

The contacting walls of the respective blocks 137 could be opened such as shown at 99 in FIG. 4 or alternately there may simply be apertures 145 therethrough to receive the corresponding portions of the display 141 which is completely enclosed within the series of blocks 137.

The particular wall or panel may include additional blocks 147 with individual indicia 149 therein such as illuminated tubular members or fluorescent tubes defined in numbers, or letters, or symbols, or interesting designs which may be connected to a single power source which is above disclosed with respect to FIGS. 2 and 5 or there may be an individual power source for each sign. In the case of the blocks 147 arranged side by side and the top block 149 there may be a single power source with sufficient electrical leads to the respective electrodes upon the respective indicia tubes such that a single power source may illuminate all of the corresponding display elements 149 of a series of such blocks.

Upon the base of the display there is shown a series of blocks 151 arranged side by side and wherein each of the blocks have enclosed therein an individual display 153 which is different in appearance and wherein there would be provided a single power source within one of the blocks adapted for suitable connection to the respective electrodes for energizing all of the indicia either in a parallel or a series circuit.

The FIG. 9 illustration merely shows other ways in which the illuminated blocks with the display or sign on the interior thereof may be used as a part of a wall or a panel for ornamental purposes or to provide information or other indicia.

The glass blocks 91 and 93 are of various sizes and can be obtained through commercial building supply companies as well as manufacturers in the United States and West Germany with the size and quality of the blocks varying from manufacturer to manufacturer. The variety and types of glass blocks available provide a wide range for novel design and usages. Wherein in references made to neon signs or displays it is contemplated as equivalent that this would include fluorescent lighting or any other type of lighting bulb.

The neon tubes in one or more of the blocks can be in any one of 15 colors or more depending upon the size of the particular display structure.

Once the block, such as shown in FIG. 4, has been cut open on the broad side or lengthwise such as employing a precision diamond saw blade, the power connection holes and vent holes are drilled for the switch 71 as well as the power lead 123.

Figure 6:
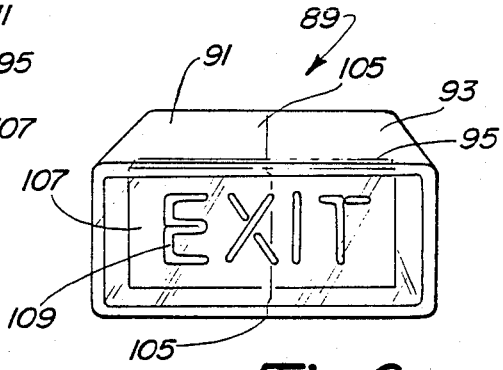
FIG. 6 is a front perspective view of the assembled glass block sign showing a modified indicia therein.

The vent and switch holes are approximately $\frac{1}{2}$ inch in diameter and the power connection holes vary in size between $\frac{1}{8}$ to $\frac{1}{2}$ inch in diameter. The neon tube 109 is mounted with a silicon glue to the wood or plastic panel 107, FIG. 4 and is inserted against the already provided groove or rim of flange 95 as a part of the glass blocks from the molding process. This is to frictionally hold the panel 107 in place upon the interior of the blocks sections such as shown in FIG. 6 and can be used for numbers of any other sign employed upon the interior of the glass block.

After inserting the neon sculpture or sign or other light source into the glass block, the neon tube properly cemented to panel 107. The neon tubing 109 is cemented at its side, top or bottom depending upon its structure such as shown at 113, FIG. 4.

When the silicon glue or other adhesive is dry, the block sections 91 and 93 are brought together and with additional silicon glue applied at the corners such as at 105, FIG. 5, the sections are sealed and secured together as a unit enclosure for the display. In the illustrative embodiment the four corners receive sufficient silicon glue to hold the block sections 91 and 93 together as a unit. Should any breakage occur to the inside neon or other sculpture, the enclosure including the blocks, has to be taken apart and is severable for access to the interior 99 of the respective blocks sections to permit repair or replacement of the neon tube or sign or display.

The estimated lifetime of the display shown in FIGS. 4 through 8 is five to ten years.

Here the tubes operate on 12 volts and therefore there is no heat production and the unit stays at room temperature. The light source 109 within the glass block is in no contact with any metal and therefore is not grounded because of the thickness of the tempered glass wall is 8 mm. to 10 mm. It is a perfect insulator and tempered according to conventional standards. The applications are endless and include indoor decor of all types such as lamps, walls, ceilings, of residences, public places such as malls, banks, restaurants, outdoor house numbers and the like.

While blocks 13 and 137, and block sections 91 and 93, are described as of glass, it is regarded as equivalent that they be made of a plastic material. Thus, the word "plastic" is included whenever reference is made to glass.

Having described my invention reference should now be had to the following claims.

I claim:

1. An illuminated display or sign comprising a pair of opposed hollow glass blocks, each block having side, top and bottom walls and a single end wall, with the adjacent open ends of the blocks aligned and in engaging registry;

adhesive means interconnecting the engaging open ends of said blocks defining a chamber;

said adhesive means being severable for access to said chamber;

each of said blocks upon the interior of their top, bottom and end walls having a central channel, with the channels of said block defining an internal peripheral mount flange;

an elongated upright mount panel of rectangular shape nested within said chamber and frictionally bearing against said mount flange;

a tubular neon display of a predetermined configuration secured upon and along said panel, and terminating at its ends in a pair of electrodes;

a transformer having primary and secondary coils anchored within said chamber and upon one of said walls, and including a pair of electrical leads extending from said secondary coil and connected to said electrodes respectively;

a manual on/off switch extending through and anchored upon one of said walls and extending into said chamber, and including a control arm upon the exterior of said wall; and a pair of power leads extending through one of said walls at their one ends adapted for connection to an electrical power source;

said power leads at their other ends being connected to said primary coil, with said switch interposed within one of said power leads.

2. In the display of claim 1, further comprising:

said power leads including a socket mounted upon the outside of said one wall;

said electrical power source including a power supply block including a transformer and a pair of prongs adapted for connection into a 110 volt AC power source;

an output connector upon said block connected to the block transformer and including a pair of lead wires terminating in a plug, assembled into said socket for delivering 12 volts AC thereto; and a plug upon the interior of said one wall electrically connected to said socket providing power to said power leads feeding said primary coil.

3. An illuminated display or sign comprising an elongated hollow glass block having side, top, bottom and end walls defining a closed chamber;

said walls being traversely severed for access to said chamber;

adhesive means interconnecting the engaging open ends of said severed blocks;

said adhesive means being severable for access to said chamber;

said block upon the interior of its top, bottom and end walls having a central channel, defining an internal peripheral mount flange;

an elongated upright mount panel of rectangular shape nested within said chamber and frictionally bearing against said mount flange;

a tubular neon display of a predetermined configuration secured upon and along said panel, and terminating at its ends in a pair of electrodes;

a transformer having primary and secondary coils anchored within said chamber and upon one of said walls, and including a pair of electrical leads extending from said secondary coil and connected to said electrodes respectively;

a manual on/off switch extending through and anchored upon one of said walls and extending into said chamber, and including a control arm upon the exterior of said wall; and a pair of power leads extending through one of said walls at their one ends adapted for connection to an electrical power source;

said power leads at their other ends being connected to said primary coil, with said switch interposed within one of said power leads.

4. An illuminated display or sign comprising:

a hollow glass block having side, top and bottom walls defining a closed chamber;

one of said walls being severable from the other walls for access to said chamber;

adhesive means interposed between and bonding the corners of said severed wall to the adjacent walls;

said bonding being severable for access to said chamber;

a tubular neon display of a predetermined design supportably mounted upon one of said walls and including a pair of spaced tubular supports projected and sealed through said one wall, with each tubular support enclosing an electrode positioned within said chamber;

a transformer having a housing anchored within said chamber;

primary and secondary coils within said housing including a pair of electrical leads extending from said secondary coil and connected to said electrodes, respectively;

a manual on/off switch extending through and anchored upon one of said walls and extending into said chamber and including a control arm upon the exterior of said wall; and a pair of power leads extending through one of said walls at their one ends adapted for connection to an electrical power source;

said power leads at their other ends being connected to said primary coil, with said switch interposed within one of said power leads;

said side walls having a series of apertures therethrough to vent said chamber, to mount said switch and to receive said power leads, respectively;

a pair of spaced heat resistant cylindrical housings closed at their one ends and at their other ends being open and extending through said one wall and secured thereto;

said tubular supports and electrodes extending into said housings and sealed therein;

the connection of said electrical leads to said electrodes including conductors on said electrodes extending through said tubular supports; and a connector extending through the closed ends of said cylindrical housings interconnecting said electrical leads and said conductors, respectively;

the sealing of said tubular supports including resilient apertured stoppers receiving said tubular supports and snugly projected into said cylindrical housings.

5. An illuminated display or sign comprising:

a hollow glass block having side, top and bottom walls defining a closed chamber;

one of said walls being severable from the other walls for access to said chamber;

a tubular neon display of a predetermined design supportably mounted upon one of said walls and including a pair of spaced tubular supports projected and sealed through said one wall, with each tubular support enclosing an electrode positioned within said chamber;

a transformer having a housing anchored within said chamber;

primary and secondary coils within said housing including a pair of electrical leads extending from said secondary coil and connected to said electrodes, respectively;

a manual on/off switch extending through and anchored upon one of said walls and extending into said chamber and including a control arm upon the exterior of said wall; and a pair of power leads extending through one of said walls at their one ends adapted for connection to an electrical power source;

said power leads at their other ends being connected to said primary coil, with said switch interposed within one of said power leads;

said side walls having a series of apertures therethrough to vent said chamber, to mount said switch and to receive said power leads, respectively;

a pair of spaced heat resistant cylindrical housings closed at their one ends and at their other ends being open and extending through said one wall and secured thereto;

said tubular supports and electrodes extending into said housings and sealed therein;

each tubular support terminating in an elongated cylindrical base having a closed end and enclosing said electrode;

the connection of said electrical leads to each electrode including a conductor on each electrode extending through said cylindrical base; and a connector extending through the closed ends of said cylindrical housings interconnecting the electrical leads and said conductors respectively.

* * * * *